US008265532B2

(12) United States Patent
Chae

(10) Patent No.: US 8,265,532 B2
(45) Date of Patent: Sep. 11, 2012

(54) IMAGE FORMING APPARATUS AND DRIVING SPEED CONTROL METHOD THEREOF

(75) Inventor: Su-kyoung Chae, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 372 days.

(21) Appl. No.: 12/572,509

(22) Filed: Oct. 2, 2009

(65) Prior Publication Data

US 2010/0104306 A1 Apr. 29, 2010

(30) Foreign Application Priority Data

Oct. 28, 2008 (KR) ..... 10-2008-0106102

(51) Int. Cl.
*G03G 15/01* (2006.01)

(52) U.S. Cl. ..... 399/302

(58) Field of Classification Search ..... 399/162, 399/165, 167, 297–302
See application file for complete search history.

(56) References Cited

U.S. PATENT DOCUMENTS 7,606,514 B2 * 10/2009 Sakai ..... 399/167
7,657,214 B2 * 2/2010 Inui et al. ..... 399/299
7,773,894 B2 * 8/2010 Shirakata ..... 399/44

FOREIGN PATENT DOCUMENTS

JP 9-123553 5/1997
KR 10-2005-0040196 5/2005

* cited by examiner

*Primary Examiner* — Hoan Tran
(74) *Attorney, Agent, or Firm* — Staas & Halsey LLP

(57) ABSTRACT

An image forming apparatus that includes an intermediate transfer belt (ITB) that has a mark, a sensor that detects the mark, a driving unit that drives the ITB, and a control unit that controls the driving speed of the driving unit, during a certain period of time after completing a printing operation, according to the detection of the mark by the sensor.

20 Claims, 6 Drawing Sheets

IMAGE FORMING APPARATUS AND DRIVING SPEED CONTROL METHOD THEREOF

CROSS-REFERENCE TO RELATED APPLICATIONS

This application claims the benefit of Korean Application No. 10-2008-0106102, filed Oct. 28, 2008, in the Korean Intellectual Property Office, the disclosure of which is incorporated herein by reference.

BACKGROUND OF THE INVENTION

1. Field of the Invention

Aspects of the present invention relate to an image forming apparatus and a speed control method thereof.

2. Description of the Related Art

Peripheral devices, such as printers, scanners, and multifunction devices, are currently being actively developed. In particular, manufactures have developed laser printers having enhanced printing quality, higher printing speeds, and less operating noise, as compared to conventional dot matrix and inkjet printers.

A laser printer performs printing operations, such as charging, writing, developing, transferring, and fusing, to print images. Charging refers to applying a high voltage (approximately 7000V) to a charging unit and forming a negative electric charge on the surface of a drum, using a coronal discharge. Writing refers to scanning a laser beam onto the surface of the charged drum, to form a latent image thereon. Developing refers to applying negatively charged toner particles to the latent image, using a developing roller that rotates in close proximity to the drum. Transferring refers to using a transfer unit to apply a positive transfer voltage to paper passing between the drum and the transfer unit, so that the toner particles on the surface of the drum are transferred to the paper. Fusing indicates fusing the toner to the paper, using heat and pressure.

A color printer forms color images using four different toners, such as cyan, magenta, yellow, and black toners. In order to more clearly print images, different organic photo conductors (OPC) are used for each of the four toners. In this case, in order to precisely transfer each toner to paper, the location of a groove on the intermediate transfer belt (ITB) is determined, so that drums of the OPCs can be synchronized with a transfer roller.

In general, if an image forming apparatus completes printing, the image forming apparatus enters a standby period, to receive any subsequent printing command, before starting a post-printing process. This is because a user may input printing commands individually, rather than inputting printing commands simultaneously, or because a plurality of documents may be commonly printed, once printing is started.

If a post-printing process is performed promptly after completing printing, and a subsequent printing command is input during the post-printing process, a pre-printing process is be performed after the post-printing process is completed, thereby causing inconvenience. Therefore, an image forming apparatus generally enters a standby mode after completing printing, to wait for a subsequent printing command.

However, when printing is performed using the above-described ITB, if a printing command is received during a standby period, the image forming apparatus generally waits until an ITB signal is received, before resuming printing, which delays the printing. Therefore, there is a need for methods of reducing a printing time.

SUMMARY OF THE INVENTION

Aspects of the present invention provide an image forming apparatus that adjusts a rotation speed of an intermediate transfer belt during a standby period, so as to reduce a printing time, and a speed control method thereof.

In accordance with an exemplary embodiment of the present invention, there is provided an image forming apparatus including: an intermediate transfer belt (ITB); a sensor that detects a mark formed on the ITB; a driving unit that drives the ITB; and a control unit that executes a first printing command, and subsequently changes the driving speed of the driving unit, during a certain period of time, according to the detection of the mark by the sensor.

According to an aspect of the present invention, the control unit may determine a current location of the mark, based on the detection of the mark by the sensor, and change the driving speed of the driving unit, such that the mark is detected a second time, within a preset time period, if a second printing command is received.

According to an aspect of the present invention, the control unit may reduce the driving speed of the driving unit during a first preset time period, before the mark is detected a second time.

According to an aspect of the present invention, the control unit may stop the driving unit at a current sensing time of the mark, or a second preset time period before the mark is detected a second time.

According to an aspect of the present invention, the preset times may be input by a manager, by a user, or may be variable.

According to an aspect of the present invention, the control unit may set a driving speed change mode of the driving unit, according to the detection of the mark by the sensor.

According to an aspect of the present invention, the driving speed change mode may be at least one of stopping the driving unit, reducing the driving speed of the driving unit, or increasing the driving speed of the driving unit.

According to an aspect of the present invention, the control unit may return the driving unit to an original driving speed, if a second printing command is received and executed, and the mark is detected.

In accordance with another exemplary embodiment of the present invention, there is provided a control method of an image forming apparatus, the method including completing a first printing operation, identifying whether a second printing operation is received during a certain period of time after completing the first printing operation, changing the driving speed of an intermediate transfer belt (ITB) before starting a post-printing process, if the second printing operation is not received, and performing the post-printing process.

According to an aspect of the present invention, the method may further include sensing the location of a mark formed on the ITB.

According to an aspect of the present invention, the changing of the driving speed may include determining a current location of the mark, based on the detection of the mark, and changing the driving speed, such that the mark is detected a second time within a preset time period, if a second printing operation is received.

According to an aspect of the present invention, the changing of the driving speed includes reducing the driving speed during a first preset time period that occurs before the mark is detected a second time.

According to an aspect of the present invention, the changing of the driving speed may include stopping the motor at a current sensing time of the mark, or a second preset time period before the mark is detected a second time.

According to an aspect of the present invention, the preset times may be input by a manager, by a user, or may be variable.

According to an aspect of the present invention, the method may further include setting a driving speed change mode.

According to an aspect of the present invention, the driving speed change mode may be at least one of stopping the ITB, reducing the driving speed of the ITB, or increasing the driving speed of the ITB.

According to an aspect of the present invention, the method may further include driving the ITB at an original driving speed, if a second printing command is received and executed, and the mark is detected.

Accordingly, the mark on the ITB can be recognized directly, so a printing time can be reduced.

Additional aspects and/or advantages of the invention will be set forth in part in the description which follows and, in part, will be obvious from the description, or may be learned by practice of the invention.

BRIEF DESCRIPTION OF THE DRAWINGS

While the following written and illustrated disclosure focuses on disclosing exemplary embodiments of the invention, it should be clearly understood that the same is by way of illustration and example only, and the invention is not limited thereto. The spirit and scope of the present invention are limited only by the terms of the appended claims. These and/or other aspects and advantages of the invention will become apparent and more readily appreciated from the following description of the exemplary embodiments, taken in conjunction with the accompanying drawings, of which:

DETAILED DESCRIPTION OF THE EMBODIMENTS

Figure 1:
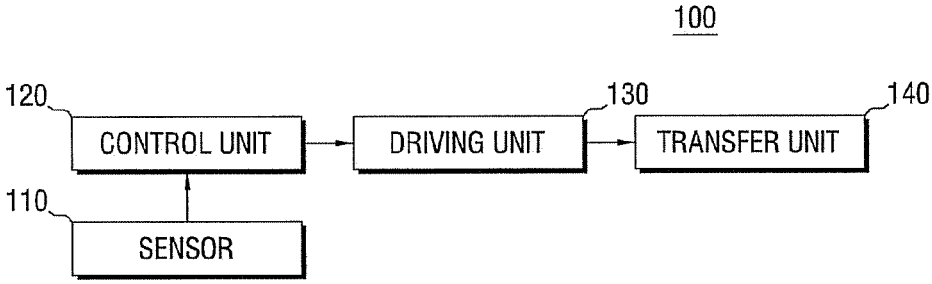
FIG. 1 is a schematic block diagram illustrating an image forming apparatus, according to an exemplary embodiment of the present invention.

Reference will now be made in detail to the exemplary embodiments of the present invention, examples of which are illustrated in the accompanying drawings, wherein like reference numerals refer to the like elements throughout. The exemplary embodiments are described below, in order to explain the aspects of the present invention, by referring to the figures.

FIG. 1 is a schematic block diagram of an image forming apparatus 100, according to an exemplary embodiment of the present invention. Referring to FIG. 1, the image forming apparatus 100 includes a sensor 110, a control unit 120, a driving unit 130, and a transfer unit 140.

The image forming apparatus 100 may be implemented as a printer, a scanner, a copier, a facsimile machine, or a multifunction peripheral performing at least two functions of the aforementioned devices. In particular, the image forming apparatus 100 may be a laser printer, or a multifunction peripheral, using a laser beam to form an electrostatic latent image on a drum, applying toner to the latent image, and fixing the toner onto a printable medium, such as paper or the like, using pressure and heat.

The image forming apparatus 100 performs charging, writing, developing, transferring, and fusing operations to print images. Since these processes are well known to those skilled in the related art, they are not described in detail, herein.

Figure 2:
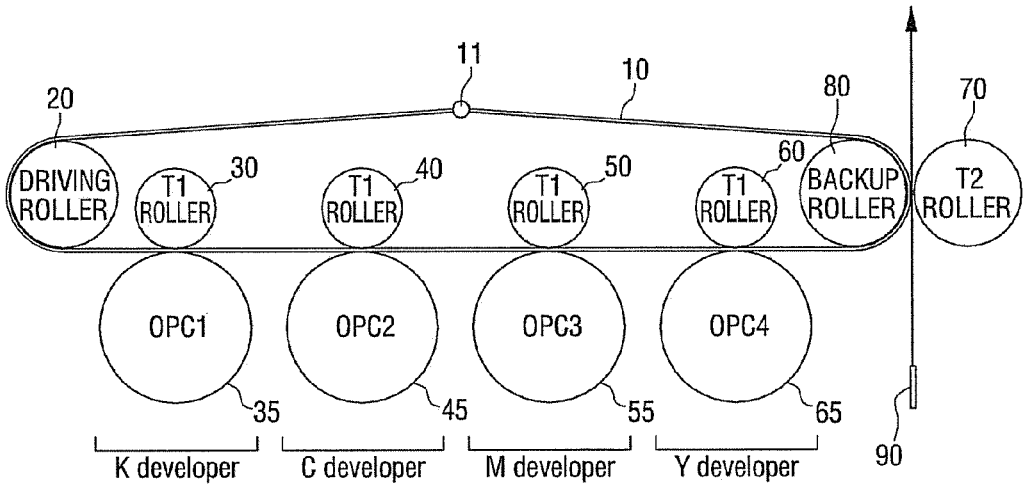
FIG. 2 is a mimetic diagram illustrating a transferring operation of an image forming apparatus, according to an exemplary embodiment of the present invention.

FIG. 2 is a diagram illustrating a transferring operation of the image forming apparatus 100. Referring to FIG. 2, the transfer unit 140 includes: an intermediate transfer belt (ITB) 10; a driving roller 20; T1 transfer rollers 30, 40, 50, 60; organic photo conductor (OPC) drums 35, 45, 55, 65; a T2 transfer roller 70; and a T2 backup roller 80.

The OPC drums 35, 45, 55, 65 respectively attach black, cyan, magenta, and yellow toner to a latent image, during a developing operation. The T1 transfer rollers 30, 40, 50, 60 correspond to the OPC drums 35, 45, 55, 65, respectively. The ITB 10 is interposed between the T1 transfer rollers 30, 40, 50, 60 and the OPC drums 35, 45, 55, 65. The toners attached to the surfaces of the OPC drums 35, 45, 55, 65 are transferred onto the surface of the ITB 10, by the T1 transfer rollers 30, 40, 50, 60. In this case, the ITB drums 35, 45, 55, 65 are synchronized with the respective T1 transfer rollers 30, 40, 50, 60, by recognizing a mark 11 formed on the ITB 10, so that a color image can be expressed. Subsequently, the color image generated on the ITB 10 is transferred onto a printable medium 90 fed between the T2 transfer roller 70 and the T2 backup roller 80. The driving roller 20 moves the ITB 10 at an appropriate speed. As described above, in order to synchronize the ITB drums 35, 45, 55, 65 with the respective T1 transfer rollers 30, 40, 50 60, the mark 11 should be recognized, so printing can be normally performed.

The sensor 110 detects the mark 11 on the ITB 10. The mark 11 can be indicia, a groove, or a hole located on the ITB 10. Herein, a "printable medium" refers to any medium suitable for having an image formed thereon, such as paper, transparencies, envelopes, or the like.

The sensor 110 may include a sensor body, a receiving unit, and a luminescent unit. A detailed description of the sensor 110 will be given later.

The control unit 120 controls the overall operation of the image forming apparatus 100. In particular, the control unit 120 controls the driving speed of the driving roller 20, to control the driving speed (rotational speed) of the ITB 10, according to the detection of the mark by the sensor 110.

That is, the control unit 120 calculates a rotation period of the ITB 10, based on the detection of the mark by the sensor 110, to determine a current position of the mark 11. The control unit 120 controls the driving speed of the driving roller 20, during a standby period that occurs after performing a series of operations according to a printing command. For example, the standby period occurs after executing a printing command. A detailed description of this operation will be described with reference to FIG. 3. Herein, a printing command or a printing operation may be generically referred to as a "print job."

The driving unit 130 may be implemented as a driving motor that supplies a certain amount of torque to the transfer unit 140, according to various currents supplied thereto, under the control of the control unit 120.

Figure 3:
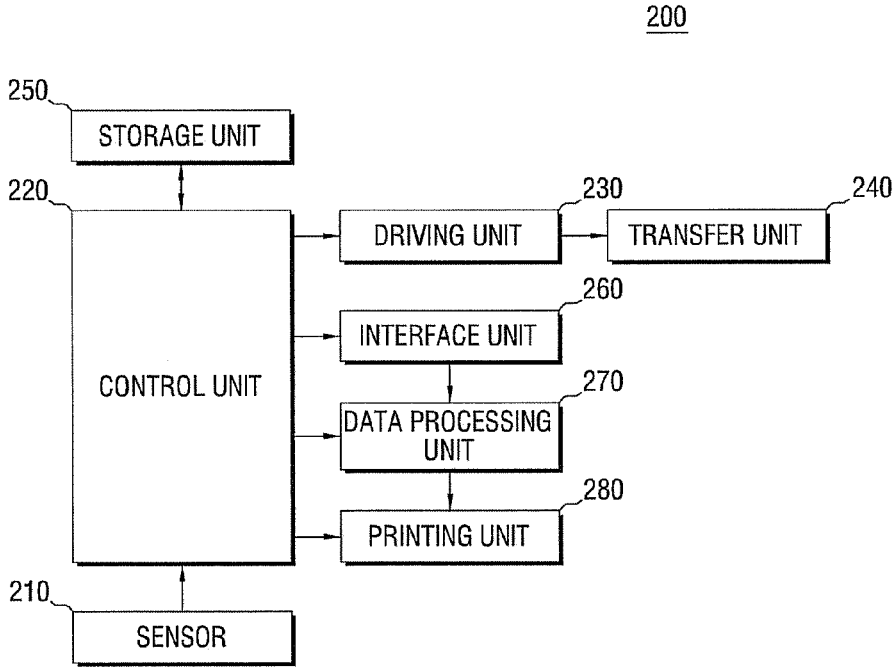
FIG. 3 is a block diagram illustrating an image forming apparatus, according to an exemplary embodiment of the present invention.

FIG. 3 is a block diagram illustrating an image forming apparatus 200, according to an exemplary embodiment of the present invention. Referring to FIG. 3, the image forming apparatus 200 includes a sensor 210, a control unit 220, a driving unit 230, a transfer unit 240, a storage unit 250, an interface unit 260, a data processing unit 270, and a printing unit 280. Elements similar to those of the image forming apparatus 100 are not described in detail.

The sensor 210 detects the mark 11 on the ITB 10, and is disposed adjacent to the ITB 10. The mark 11 and the sensor 210 may be implemented in various forms.

For example, if the mark 11 is a light-penetratable unit, the sensor 210 may include a sensor body, a receiving unit, and a luminescent unit. That is, the sensor 210 may include a sensor body, a first sensing element (a luminescent unit), and a second sensing element (a light receiving unit), which are spaced apart from both sides of the ITB 10. Such a sensor 210 detects light from the first sensing element, which passes through the mark 11 and is received by the second sensing element. That is, light irradiated from the first sensing element passes through a location sensor and reaches the second sensing element, so that the mark 11 can be recognized. However, this is merely an example, and the mark 11 and the sensor 210 may be implemented in a various other forms known to those skilled in the related art.

The control unit 220 controls the driving speed of the driving roller 20, according to the detection of the mark 11 by the sensor 210. That is, the control unit 220 sets a driving speed change mode (changes/sets the driving speed), according to when the mark 11 is detected by the sensor 210. According to the set driving speed, the driving unit 230, which supplies a driving force to the driving roller 20, speeds up, slows down, or stops the ITB 10, i.e., controls the driving speed/period of rotation of the ITB 10.

In particular, the control unit 220 controls the driving speed, according to the detection of the mark by the sensor 210, during a preset standby period that occurs after a printing command is executed (after a print job is performed). The execution of the print command can include operations such as charging, writing, developing, transferring, and fusing.

According to an exemplary embodiment, the control unit 220 calculates a rotation period of the ITB 10, by determining an interval between detection times of the mark 11, i.e., the amount of time that elapses between a first and a second detection of the mark 11. Accordingly, the current location of the mark 11 can be determined, by referencing the interval.

The driving unit 230 supplies various amounts of torque to the driving roller 20, according to the control of the control unit 220. The storage unit 250 may include a read-only memory (ROM) and/or a random-access memory (RAM). A ROM is a non-volatile memory element, and may include a test routine of the image forming apparatus 200 and operational signals to operate the image forming apparatus 200. In addition, the ROM may include all the commands of the control unit 220, which are used to operate the image forming apparatus 200.

A RAM is a volatile memory element which may be a dynamic RAM (DRAM: a RAM to refresh charge periodically so as to maintain data), which temporarily stores information to be printed. The RAM may include a storage buffer (not shown), a line print buffer (not shown), and a work area.

The storage unit 250 stores a rotation period of the ITB 10 and a most recent sensing time of the mark 11. The storage unit 250 provides this information to the control unit 220, so the control unit 220 can calculate a subsequent detection time of the mark 11.

The interface unit 260 externally receives printing commands and printing data. The data processing unit 270 processes the printing data to appropriately print the printing data on the printable medium 90.

The printing unit 280 prints the processed printing data on the printable medium 90. That is, the printing unit 280 converts the processed printing data into a toner image, and prints the toner image using a developer, such as a toner.

When printing is completed, the printing unit 280 enters a standby mode/period. If a subsequent printing command is not received during the standby period, the printing unit performs a post-printing process. During the standby period, the ITB 10 keeps rotating. A rotation period of the ITB 10 depends on the rotation speed of the driving roller 20 and the length of the ITB 10. While the ITB 10 is rotating, the mark 11 on the ITB 10 is repeatedly moved past, and detected by, the sensor 210.

The control unit 220 determines the current location of the mark 11, based on the detection of the mark by the sensor 210. If a subsequent printing command is received during the standby period, the control unit 220 changes the driving speed of the driving roller 20, such that the mark 11 can be detected within a set time period.

More specifically, the control unit 220 reduces the driving speed of the driving roller 20 for a first time period, which is before a subsequent detection time the mark 11, or stops the driving roller 20 for a second time period before the mark 11 is subsequently detected. The first and second time periods may be input or modified by a manager or a user, according to the printing speed of the image forming apparatus 200. In other words, the control unit 220 can reduce the driving speed when the mark 11 is a relatively short distance from the sensor 210, and can increase the driving speed when the mark 11 is a relatively long distance from the sensor 210. Herein, the distances from the sensor refer the distance the mark 11 travels before reaching the sensor 210, with respect to the rotation path of the ITB 10.

The control unit 220 calculates a subsequent detection time of the mark 11, based on when the mark 11 was previously detected, and a rotation period of the ITB 10. For example, if the image forming apparatus 200 has a printing speed of 16 ppm, the rotation period of the ITB 10 would be 3.75 seconds, and the subsequent detection time of the mark 11 would be calculated based on this information. This is merely an example, so the subsequent sensing time can be calculated using another method known to those skilled in the related art.

In an exemplary embodiment of the present invention, the control unit 220 reduces the driving speed of the driving roller 20 for the first time period, which is before a subsequent detecting time of the mark 11. For example, if a rotation period of the ITB 10 is 3.75 seconds (printing speed 16 ppm), the control unit 220 reduces the driving speed of the driving roller 20 for a period of 2 seconds before the subsequent sensing time of the mark 11, so that the mark 11 can be rapidly detected if a subsequent printing command is received. In this case, if the driving speed V of the driving roller 20 is reduced to V/2, the mark 11 can be detected after 4 seconds, i.e., the first time period is 4 seconds.

In another exemplary embodiment of the present invention, the control unit 220 stops the driving roller 20 a second time period before a subsequent sensing time of the mark 11. For example, if the rotation period of the ITB 10 is 3 seconds (printing speed 20 ppm), the control unit 220 stops the driving roller 20 1 second before the mark 11 would otherwise be detected, so that the mark 11 can be rapidly detected again, if a subsequent printing command is received.

In another case, the control unit 220 stops the driving roller 20 at a current sensing time of the mark 11, thereby stopping movement of the ITB 10. In other words, the control unit 220 stops the ITB 10, while the mark 11 is disposed within the detection range of the sensor 210.

In yet another exemplary embodiment of the present invention, the control unit 220 increases the driving speed of the driving roller 20, during a third time period after the mark 11 is detected. That is, the control unit 220 rotates the ITB 10 faster by increasing the driving speed of the driving roller 20, so that the mark 11 can be rapidly detected if a subsequent printing command is received. For example, if a rotation period of the ITB 10 is 3.75 seconds (printing speed of 16 ppm), the control unit 220 increases the driving speed of the driving roller 20 for approximately 2 seconds after the mark 11 is detected. Accordingly, if a subsequent printing command is received, the mark 11 can be rapidly detected again. However, this is merely an exemplary embodiment, since the rotation speed of the ITB 10 varies according to the printing speed of the image forming apparatus 200.

If a subsequent printing command is received within the standby period, and the mark 11 is rapidly detected, by changing the driving speed of the driving roller 20, and the control unit 220 executes the subsequent printing command. In this case, the control unit 220 returns to the original driving speed (printing speed) of the driving roller 20.

If a subsequent printing command is not received within the standby period, the printing unit 280 performs a post-printing process, according to the control of the control unit 220. The post-printing process is an operation that prepares the image forming apparatus for other print jobs.

For example, in a gray-scale image forming apparatus, a post-printing process may include cleaning, and in a color image forming apparatus, a post-printing process may include cleaning, adjusting color strength, and adjusting a color register. In brief, the cleaning refers to removing residual toner from the surface of the developing roller, and may be performed by the printing unit 180. The adjusting of the color strength refers to regulating the concentration of pigments in the toner. The adjusting of the color register refers to amending a color register, so as to make a non-supplied color, and may be performed by the printing unit 180.

Figure 4A:
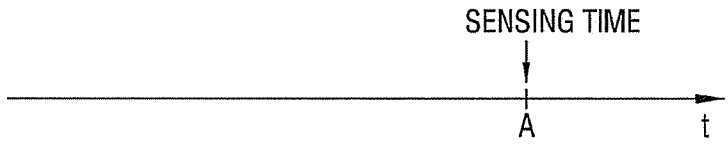
FIGS. 4A, 4B and 4C illustrate a rotation speed control method speed of an intermediate transfer belt, according to various embodiments of the present invention.
Figure 4B:
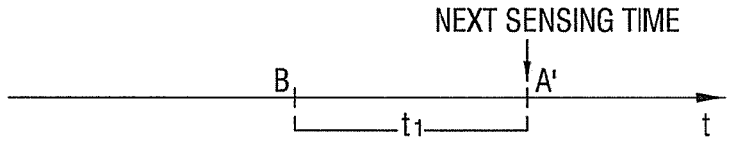
Figure 4C:
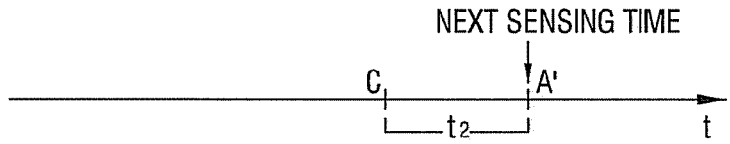

FIGS. 4A and 4C illustrate a method of controlling the rotation speed of the ITB 10, according to various embodiments of the present invention. Referring to FIG. 4A, the driving speed of the driving roller 20 is reduced during the first preset time period (t1) before a subsequent detection time (A') of the mark 11, so if a subsequent printing command is received, the mark 11 can be rapidly detected. For example, if a rotation period of the ITB 10 is 3 seconds (printing speed of 20 ppm), the rotational speed of the driving roller 20 is reduced 2 seconds before a subsequent detection time of the mark 11 would otherwise occur, so if a subsequent printing command is received, the mark 11 can be rapidly detected.

Referring to FIG. 4B, the driving roller 20 is stopped a second preset time period (t2) before a subsequent detection time (A') of the mark 11. Therefore, if a subsequent printing command is received, the mark 11 can be rapidly detected. For example, if the rotation period of the ITB 10 is 3 seconds (printing speed of 20 ppm), the driving roller 20 stops 1 second before the subsequent detection time of the mark 11, so if a subsequent printing command is received the mark 11 can be rapidly detected.

Referring to FIG. 4C, if the mark 11 is detected, the driving speed of the driving roller 20 is increased for a third time period (t3), after the mark 11 is detected. Accordingly, if a subsequent printing command is received, the mark 11 can be rapidly detected. For example, if a rotation period of the ITB 10 is 3.75 seconds (printing speed 16 ppm), the rotation speed of the driving roller 20 is increased for 2 seconds, after the mark 11 is detected. Therefore, if a subsequent printing command is received, the mark 11 can be rapidly detected. The time periods t1 and t2 are within the standby period T.

Figure 5:
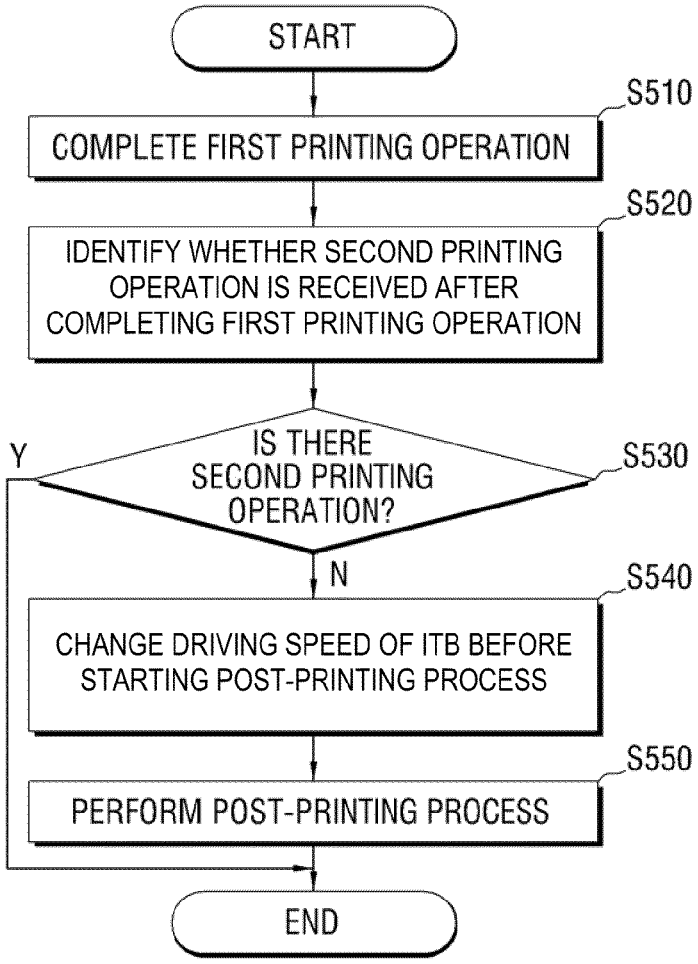
FIG. 5 is a flowchart illustrating a rotation speed control method of an image forming apparatus, according to an exemplary embodiment of the present invention.

FIG. 5 is a flowchart illustrating a motor control method of the image forming apparatuses 100 and 200, according to exemplary embodiments of the present invention. In operation S510, a first printing operation is completed, according to a first printing command. In operation S520, it is determined whether a second printing command is received, during a certain period of time (standby period).

In operation S530: if the second printing command is not received, the method proceeds to operation S540. In operation S540, the driving speed the ITB 10 is changed during the standby period, before starting a post-printing process. In operation S550, once the standby period elapses, the post-printing process is performed.

Figure 6:
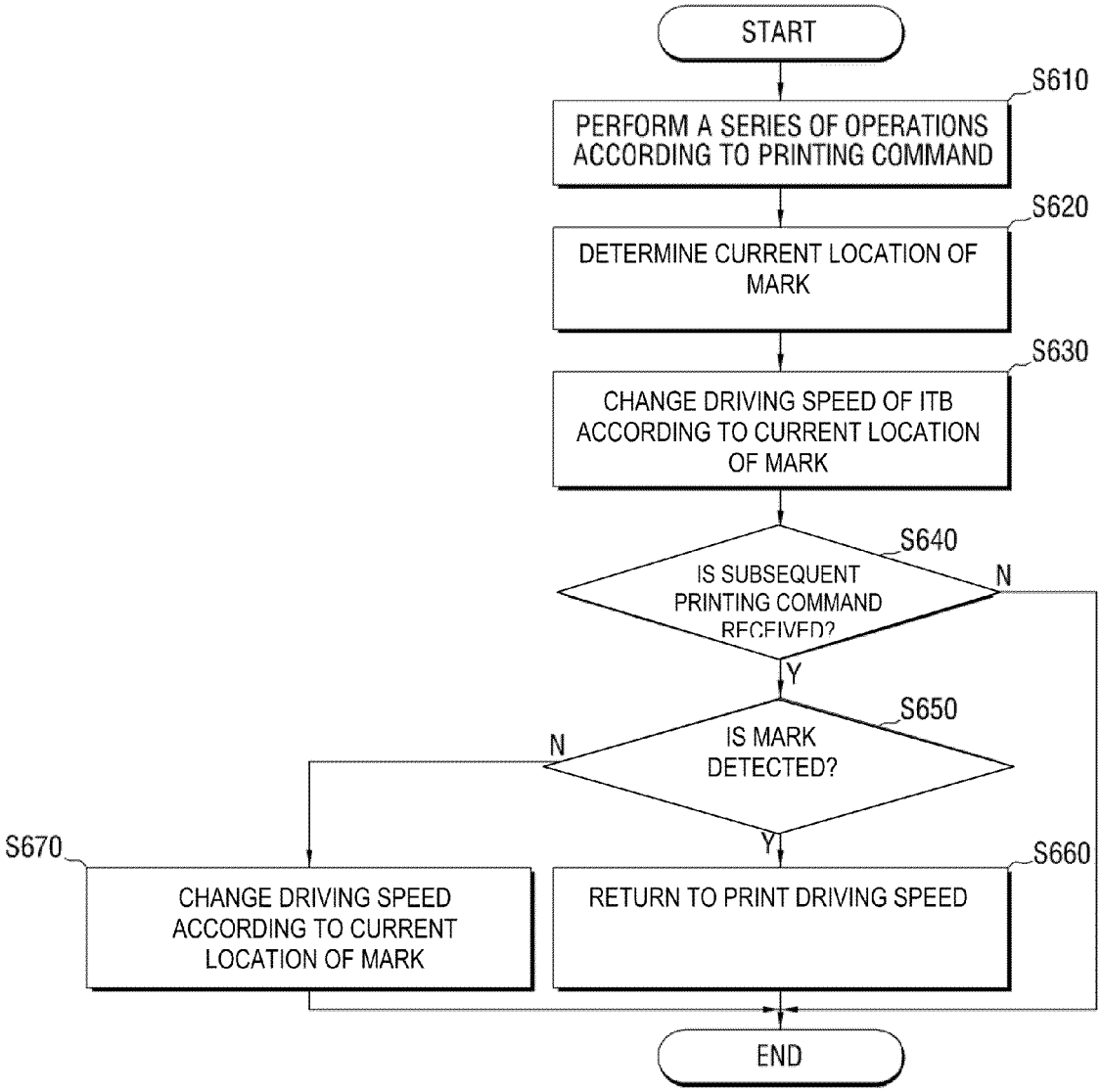
FIG. 6 is a flowchart illustrating the speed control method of FIG. 5, in greater detail.

FIG. 6 is a flowchart illustrating a control method of the image forming apparatuses 100 and 200. Referring to FIG. 6, in operation S610, a series of operations are performed according to a printing command, i.e., a print job is executed to print images. Subsequently, in operation S620, the mark 11 is detected during a standby period, and the current location of the mark 11 is determined, based on the detection of the mark 11.

For example, a rotation period of the ITB 10 is calculated by measuring an interval between two detections of the mark 11. The current location of the mark 11 can be determined accordingly.

In operation S630, a driving speed change mode of the motor (the driving speed of the ITB 10) is set according to the current location of the mark 11. In particular, the driving speed of the ITB 10 is increased, decreased, or the ITB is stopped, according to the driving speed change mode. The driving speed is changed by changing the voltage applied to a motor that drives the ITB 10.

For example, the driving speed may be reduced when the mark 11 is detected, or during a first time period prior to a subsequent detection time of the mark 11. Alternatively, the motor may be stopped a second time period prior to the subsequent detection time of the mark 11. Alternatively, the driving speed of the motor may be increased during a third time period after the mark 11 is detected, so that the mark 11 can be subsequently detected in a shorter time.

In operation S640, it is determined whether a subsequent printing command is received during the standby period. If a subsequent printing command is received, the method proceeds to operation S650. In operation S650, it is determined whether the mark 11 is currently being detected.

If the mark 11 is currently being detected, the method proceeds to operation S660. In operation 660, the driving speed is set to an original driving speed (printing speed), so as to normally perform printing, according to the subsequent printing command.

If the mark 11 is not detected, the method proceeds to operation S670. In operation 670, the driving speed of the motor is changed, according to the current location of the mark 11. Therefore, if a subsequent printing command is received, a printing time can be reduced, by reducing the time needed to detect the mark 11.

Although a few exemplary embodiments of the present invention have been shown and described, it would be appreciated by those skilled in the art that changes may be made in these exemplary embodiments, without departing from the principles and spirit of the invention, the scope of which is defined in the claims and their equivalents.

What is claimed is:

1. An image forming apparatus comprising:

an intermediate transfer belt (ITB) having a mark;

a sensor that detects the mark, when the ITB moves the mark to the sensor;

a driving unit that drives the ITB; and a control unit that determines a current location of the mark, based on the detection of the mark by the sensor, and changes the driving speed of the driving unit, according to the proximity of the mark to the sensor, during a standby period that occurs after the control unit completes a first print job.

2. The image forming apparatus according to claim 1, wherein the control unit changes the driving speed of the driving unit, such that the mark is detected by the sensor within a set time period, if a second print job is received during the standby period.

3. The image forming apparatus according to claim 2, wherein the control unit reduces the driving speed of the driving unit, for a first set time period before the mark would have been detected by the sensor.

4. The image forming apparatus according to claim 3, wherein the first set time period is preset by a user, or is variable.

5. The image forming apparatus according to claim 2, wherein the control unit stops the driving unit, when the mark is detected by the sensor, or a second set time period before the mark would have been detected by the sensor.

6. The image forming apparatus according to claim 5, wherein the second set time period is preset by a user, or is variable.

7. The image forming apparatus according to claim 1, wherein the control unit increases the driving speed of the driving unit, decreases the driving speed of the driving unit, or stops the driving unit, according to the current location of the mark.

8. The image forming apparatus according to claim 1, wherein the control unit sets the speed of the driving unit to a print driving speed, to execute a second print job, if the second print job is received during the standby period, and the mark is currently detected by the sensor.

9. A control method of an image forming apparatus that includes an intermediate transfer belt (ITB) having a mark, the method comprising:

executing a first print job;

detecting whether a second print job is received during a standby period that occurs after the first print job is completed;

changing the driving speed of the ITB during the standby period, according to the location of the mark, if the second print job has not been received; and performing the post-printing process after the expiration of the standby period.

10. The method according to claim 9, further comprising periodically detecting the mark on the ITB as the ITB is driven.

11. The method according to claim 10, wherein the changing of the driving speed comprises:

determining a current location of the mark, based on the detection of the mark; and changing the driving speed, such that the mark is detected within a set time period, if the second print job is received.

12. The method according to claim 10, wherein the changing of the driving speed comprises reducing the driving speed for a first set time period prior to when the mark would have been detected.

13. The method according to claim 12, wherein the first set time period is preset by a user, or is variable.

14. The method according to claim 10, wherein the changing of the driving speed comprises stopping the ITB when the mark is currently detected, or a second set time period prior to when the mark would have been detected.

15. The method according to claim 14, wherein the second set time period is preset by user, or is variable.

16. The method according to claim 10, further comprising: setting the driving speed to a printing speed, to execute a second print job, if the second print job is received during the standby period, and the mark is currently being detected.

17. The method according to claim 9, wherein the changing of the driving speed comprises at least one of stopping the ITB, reducing the driving speed of the ITB, or increasing the driving speed of the ITB.

18. An image forming apparatus comprising:

an intermediate transfer belt (ITB) having a mark;

a sensor that detects the mark, when the ITB moves the mark within a detection range of the sensor; and a control unit that determines a current location of the mark, based on the detection of the mark by the sensor, and changes the driving speed of ITB, according to the proximity of the mark to the sensor, during a standby period that occurs after the control unit completes a print job.

19. The image forming apparatus according to claim 18, wherein during the standby period the control unit:

increases the driving speed of the ITB, if the mark is located more than a first rotational distance from the sensor;

decreases the driving speed of the ITB, if the mark is located less than the first rotational distance from the sensor; and stops the ITB, if the mark is located within the detection range of the sensor.

20. The image forming apparatus according to claim 19, wherein the control unit sets the driving speed of the ITB to a print driving speed, if a print job is received during the standby period.

* * * * *